US009074841B2

(12) United States Patent
Bugge et al.

(10) Patent No.: US 9,074,841 B2
(45) Date of Patent: Jul. 7, 2015

(54) ACTUATION SYSTEM AND METHOD FOR MISSILE CONTAINER DOORS

(71) Applicant: Raytheon Company, Waltham, MA (US)

(72) Inventors: John F. Bugge, Tucson, AZ (US); Dylan Foster Bixby, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 106 days.

(21) Appl. No.: 14/031,946

(22) Filed: Sep. 19, 2013

(65) Prior Publication Data

US 2015/0075357 A1 Mar. 19, 2015

(51) Int. Cl.
*F41F 3/077* (2006.01)
*F41F 3/042* (2006.01)

(52) U.S. Cl.
CPC ..... *F41F 3/042* (2013.01); *F41F 3/077* (2013.01)

(58) Field of Classification Search
CPC ..... F41F 3/077
USPC ..... 89/1.815–1.817, 1.804, 1.8
See application file for complete search history.

(56) References Cited

U.S. PATENT DOCUMENTS

| | | | | |
|---|---|---|---|---|
| 3,861,271 | A * | 1/1975 | Osborn, Jr. | 89/1.8 |
| 4,263,863 | A * | 4/1981 | Leitch | 114/201 R |
| 4,970,937 | A * | 11/1990 | Ward | 89/1.817 |
| 6,755,111 | B2 * | 6/2004 | Ciappi | 89/1.817 |
| 8,087,336 | B2 * | 1/2012 | Fleischer et al. | 89/1.8 |
| 2014/0224104 | A1 * | 8/2014 | Kempas | 89/1.815 |

* cited by examiner

*Primary Examiner* — Reginald Tillman, Jr.
(74) *Attorney, Agent, or Firm* — Renner, Otto, Boisselle & Sklar, LLP

(57) ABSTRACT

A missile container sealing assembly includes an end cap capable of sealing an end of a container for a missile, and one or more linkage assemblies for controllably opening the end cap. The end cap has a frame portion that defines an opening for a missile and is mountable to the end of the missile container, and a door portion that includes one or more doors that close and seal the opening in the frame portion. Each linkage assembly is associated with a respective one of the one or more doors, for opening the doors relative to the frame portion. Moreover, each linkage assembly includes a link that transmits a force ahead of the leading end of the missile to open the doors and permit the missile's egress through the opening.

20 Claims, 10 Drawing Sheets

ACTUATION SYSTEM AND METHOD FOR MISSILE CONTAINER DOORS

FIELD OF THE INVENTION

The invention relates to missile systems, and in particular to missile systems where individual missiles are sealed in respective containers prior to launch.

BACKGROUND

Some missile systems seal individual missiles in a container for storage, transport, and protection from the environment, and then launch the missile directly from the sealed container.

Many methods exist for sealing missile containers and permitting missile egress at launch. These methods often depend upon either a separately powered actuation system to open the container in advance of the missile, typically requiring a delay between the door opening and the launch of the missile to ensure the door is open prior to launch, or require the missile to pierce a protective cover that seals the container.

SUMMARY

Prior missile container egress methods often are overly complex, making them more difficult and expensive to manufacture, and potentially less reliable in operation; or can damage sensitive missile surfaces upon launch and egress.

The present invention provides a simple mechanism that releases, actuates, and controls a missile container door entirely through the motion of the missile itself as the missile's propulsion system starts and the missile is released for launch, maintaining control of the separation between the doors and the missile throughout launch.

More particularly, the present invention provides a missile container sealing assembly including an end cap capable of sealing an end of a container for a missile, and one or more linkage assemblies for controllably opening the end cap. The end cap has a frame portion that defines an opening for a missile at an end of a container and is mountable to the end of a missile container, and a door portion that includes one or more doors that close and seal the opening in the frame portion, each door being hingedly mounted to the frame portion. Each linkage assembly is associated with a respective one of the one or more doors, for opening the doors relative to the frame portion to permit a missile to exit through the opening in the frame portion. Moreover, each linkage assembly includes a first link, a second link pivotally connected to the first link and to the door at a location removed from the connection to the first link, and a guide track. The first link is pivotally connected to the guide track at a location removed from the connection between the first link and the second link, and the first link is mounted for sliding movement relative to and along the guide track. The first link further includes a surface against which a force can be applied to move the connection along the guide track and to transfer a force to the first link and the door to cause the door to open.

Additional features provided by one or more embodiments of the invention include: (a) both the frame portion and the door portion are formed as a unitary structure, and the one or more doors are defined by frangible tear lines in the unitary structure that separate the one or more doors from the frame portion, and from each other if there is more than one door; (b) the end cap includes one or more hinges mounted to both the frame portion and each of the one or more doors, such that the doors can be rotated relative to the frame portion; (c) the hinges are mounted on an outside surface of the frame portion and the one or more doors; (d) the door portion is substantially planar; (e) the frame portion has a skirt that extends in a direction perpendicular to the door portion; (f) the guide track defines a longitudinally-extending path; (g) the guide track is open adjacent the frame; and (h) the guide track defines a nonlinear path.

Some embodiments can additionally or alternatively include at least two recesses in the frame portion and a locking assembly adjacent at least one door that cooperates with the recesses in the frame portion to lock the door in place. The locking assembly includes a pair of locking bolts and a spring associated with each bolt that biases the bolt out of engagement with the frame portion, and a latch release connected to the second link. The bolts are mounted to the door, aligned with the recesses in the frame portion, and are movable between a locking position where the bolts are received in respective recesses, and a releasing position where the bolts are retracted from the recesses. The latch release holds the bolts in the locking position and the springs bias the bolts against the latch release, such that movement of the latch release permits the bolts to move to the biased releasing position. In some embodiments, the bolts lie in a plane parallel to and adjacent the door portion.

The sealing assembly can further include an optional locking assembly including one or more bolts mounted between the door portion and the frame portion to lock the door in place, and a release means mounted between the bolts and the second link for retaining the bolts in engagement with the frame portion. Movement of the release means allows the bolts to disengage the frame portion, thereby allowing the door to open. The release means can include a latch release pivotally mounted to the door or the latch release can have a cam surface.

Thus the end cap can include one or more recesses in the frame portion of the unitary structure; and bolts parallel to the door portion that are received in the recesses for providing structural support to the doors adjacent the frangible tear lines, the bolts being separate from the one or more linkage assemblies.

The sealing assembly can further include a collar for surrounding at least a nose portion of a missile. The collar is mounted for sliding movement relative to and along the guide path, such that movement of the collar along the guide path causes contact with and movement of the first link.

In some embodiments, the collar extends along a lateral length, where the guide track defines a nonlinear path, and the nonlinear path includes a portion outwardly removed from a path of the collar along the guide track.

The present invention can further provide a sealing assembly with a container having an open end, and a missile contained in the container. The end cap is mounted to the container to close and seal the open end of the container, and the first link is connected to the missile such that ignition of the missile pushes the missile against the first link, urging the first link along the guide track.

More particularly, the frame portion of the end cap is attached to the container, and the first link is connected to the missile through a collar.

The present invention also provides a method of opening a missile container of a missile system during egress of a missile from the missile container, the missile system including the missile container and the missile contained therein. The method includes the steps of: (a) initiating missile launch to move a missile collar against a linkage coupled to a door in an end cap sealing an end of the missile container, the linkage including a first link coupled between a second link and the collar coupled to the missile, and a second link coupled between the first link and the door; (b) sliding the first link along a guide track contained at least partially within the missile container; (c) rotating the second link relative to the door via contact with the first link; and (d) opening the door of the missile container via transfer of force from the second link to the door, causing the door to rotate away from a path of the missile.

The foregoing and other features of the invention are hereinafter fully described and particularly pointed out in the claims, the following description and the annexed drawings setting forth in detail one or more illustrative embodiments of the invention. These embodiments, however, are but a few of the various ways in which the principles of the invention can be employed. Other objects, advantages and features of the invention will become apparent from the following detailed description of the invention when considered in conjunction with the drawings.

DETAILED DESCRIPTION

Figure 1:
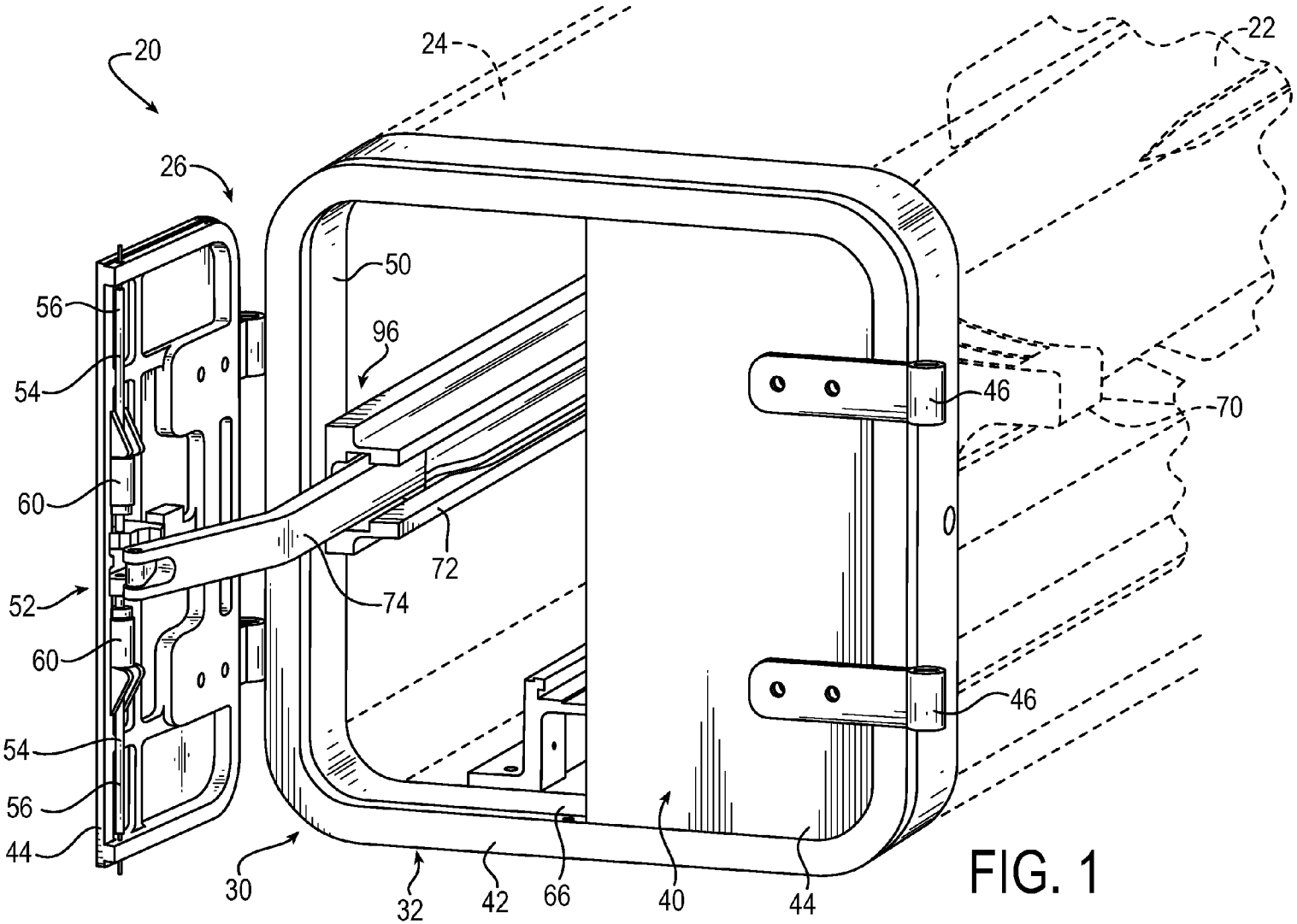
FIG. 1 is a schematic perspective view of a portion of a missile system including a missile container sealing assembly provided by the invention in an open condition.
Figure 2:
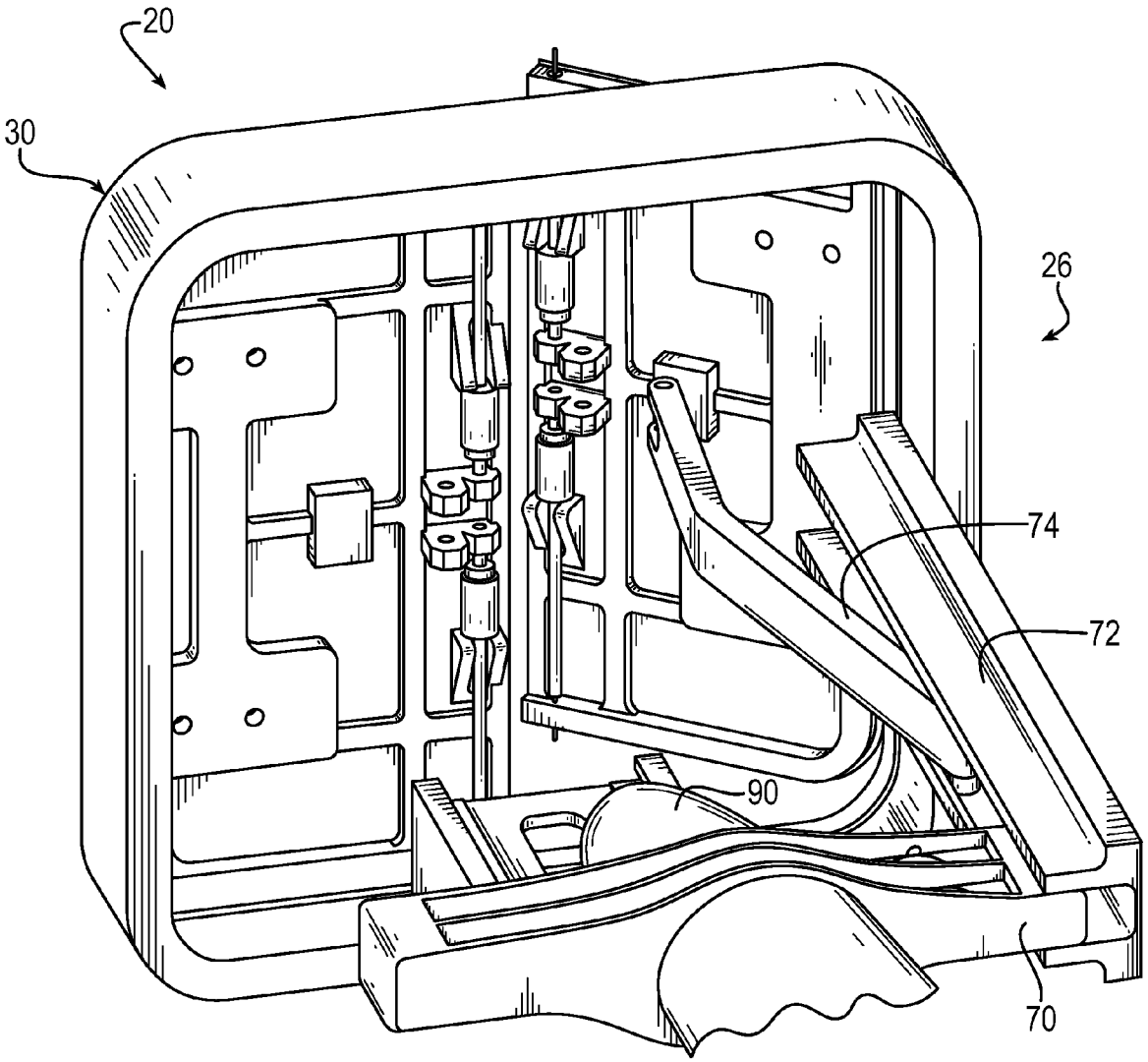
FIG. 2 is an alternate view of the missile system and sealing assembly of FIG. 1.

Referring now to the drawings in detail, the present invention provides a system 20 for storing and launching a missile 22 from a sealed container 24. In an exemplary application, multiple missiles, each contained in its own sealed container, can be deployed in a multiple-launch missile system, for example, such as in a vertically-launched interceptor system mounted on a multiple launch mobile platform. The containers provide environmental protection and also act as the missile launch tube. Thus the container 24 allows the missile 22 to be moved between storage and deployment without unsealing the container 24 and exposing the missile 22 to environmental conditions.

A forward face of the container 24, as well as being environmentally sealed, may need to protect its contents from the effects of the launch of a missile from an adjacent missile container, while also providing free egress of the contained missile at its launch without risk of damage to the missile itself.

Accordingly, the present invention provides a missile container sealing assembly 26 for a missile container 24 that includes an end cap 30 that mounts on the container 24 to provide a sealed forward face 32, and one or more linkage assemblies 34 for opening the end cap 30 upon ignition of a missile 22 in the container 24. The end cap 30 provides an environmental seal on the end face 32 of the container 24, and includes a door portion 40 and a surrounding frame portion 42.

The door portion 40 is substantially planar, and includes one or more doors 44 that can be opened relative to the frame portion 42. In the illustrated embodiment, the door portion 40 includes two doors 44, although any number of doors may be employed. A single-door system is easier to seal, but has more difficulty overcoming the pressure of an adjacent missile's launch. The system 20 shown in the drawings uses two doors 44, significantly reducing loads and inertias as compared to a single door. Using multiple doors 44 can reduce the forces required to open door portion 40 by a factor of four in comparison to a single door. Each door 44 is connected to the frame portion 42 by one or more hinges 46 mounted to the outside of the door portion 40, such that upon separation of the door 44 from the frame portion 42 the door 46 is pivotably movable relative to the frame portion 42.

In the illustrated embodiment, two hinges 46 are mounted to both the outside surface of the frame portion 42 and to an outside surface of each respective door 44, and the respective hinge portions fold upon themselves upon opening of the doors 44. Alternatively, one or more hinges 46 may be mounted to the inside surface of the frame portion 42, to an outside surface of a respective door 44, or a combination thereof. The hinges 46 also can provide structural support for the doors 44 through the connection to the frame portion 42.

The frame portion 42 has a peripheral skirt or flange 50 that generally extends transverse the door portion 40, typically perpendicular to the door portion 40, and is mountable to a forward end 32 of the container 24. The frame portion 42 can be attached to the container 24 via bolts, screws, pins, adhesives, welding, or any other suitable means of attachment.

To ensure an effective seal for multiple doors 44, both the door portion 40 and the frame portion 42 are formed as a single unitary structure. This structure generally is machined from one billet of material (such as an aluminum alloy). A continuous thin section between and around each door 44 leaves a tearable web of material (approximately 0.025 cm (0.010 inch) thick) forming frangible tear lines in the unitary structure. Using a single, continuous piece of material to make both the door portion 40 and the frame portion 42 makes it easier for the end cap 30 to seal the container 24, even with multiple doors 44. The end cap 30 is attached to the missile container 24 as one element.

In opening the door or doors 44, each door 44 breaks free from the frame portion 42 by tearing the web of material along the tear lines. This tearable web is protected from prematurely tearing and breaking the seal by the hinges 46 and by an integrally machined and fitted locking assembly 52. Each door 44 in the end cap 30 typically includes a respective locking assembly 52 that prevents the doors 44 from opening prematurely and breaking the seal, and reinforces the door portion 40 of the end cap to provide an exact restraint against door opening.

Figure 9:
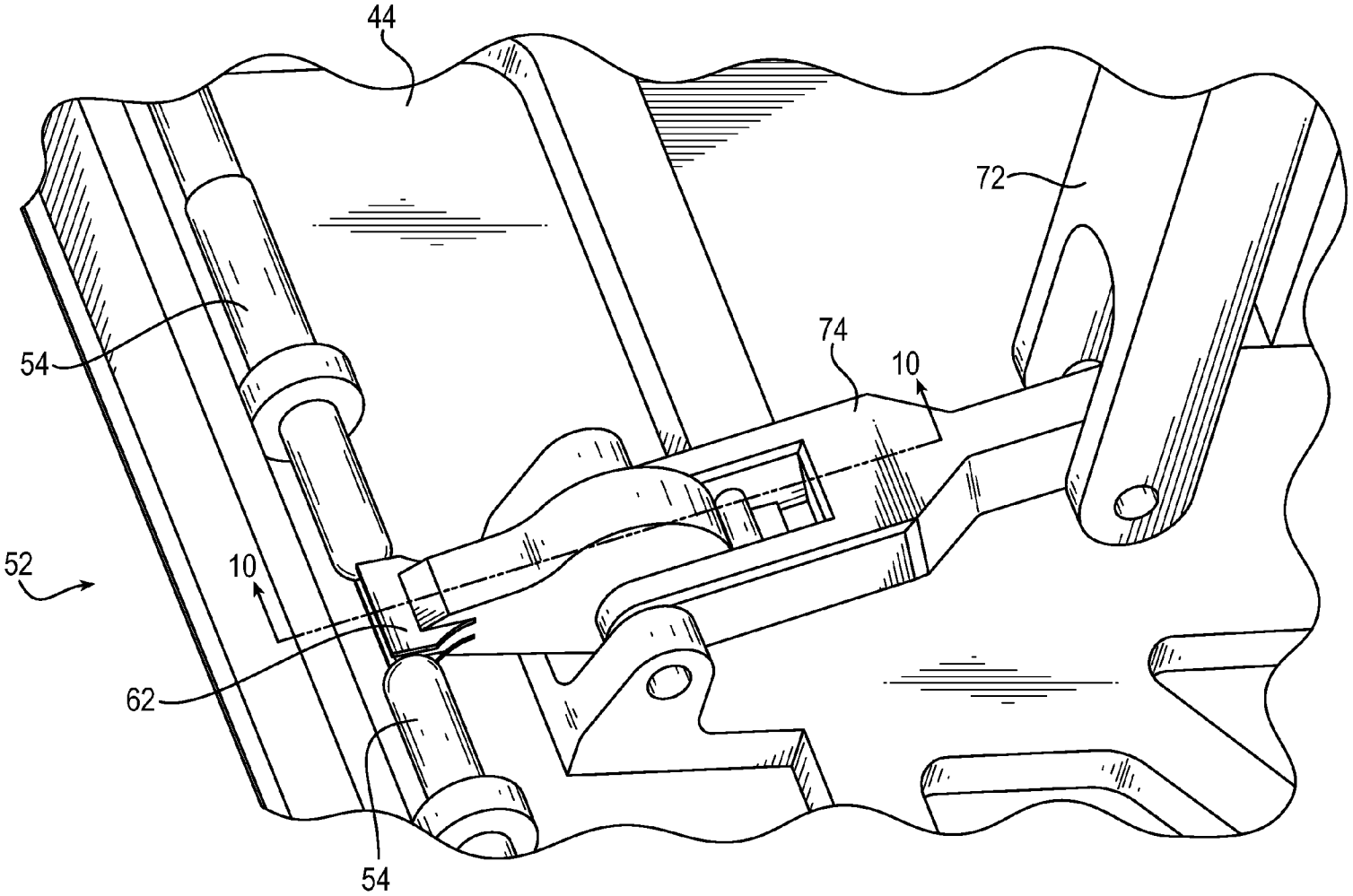
FIG. 9 is an enlarged view of an alternate latch release mechanism provided by the present invention in a locked position.
Figure 10:
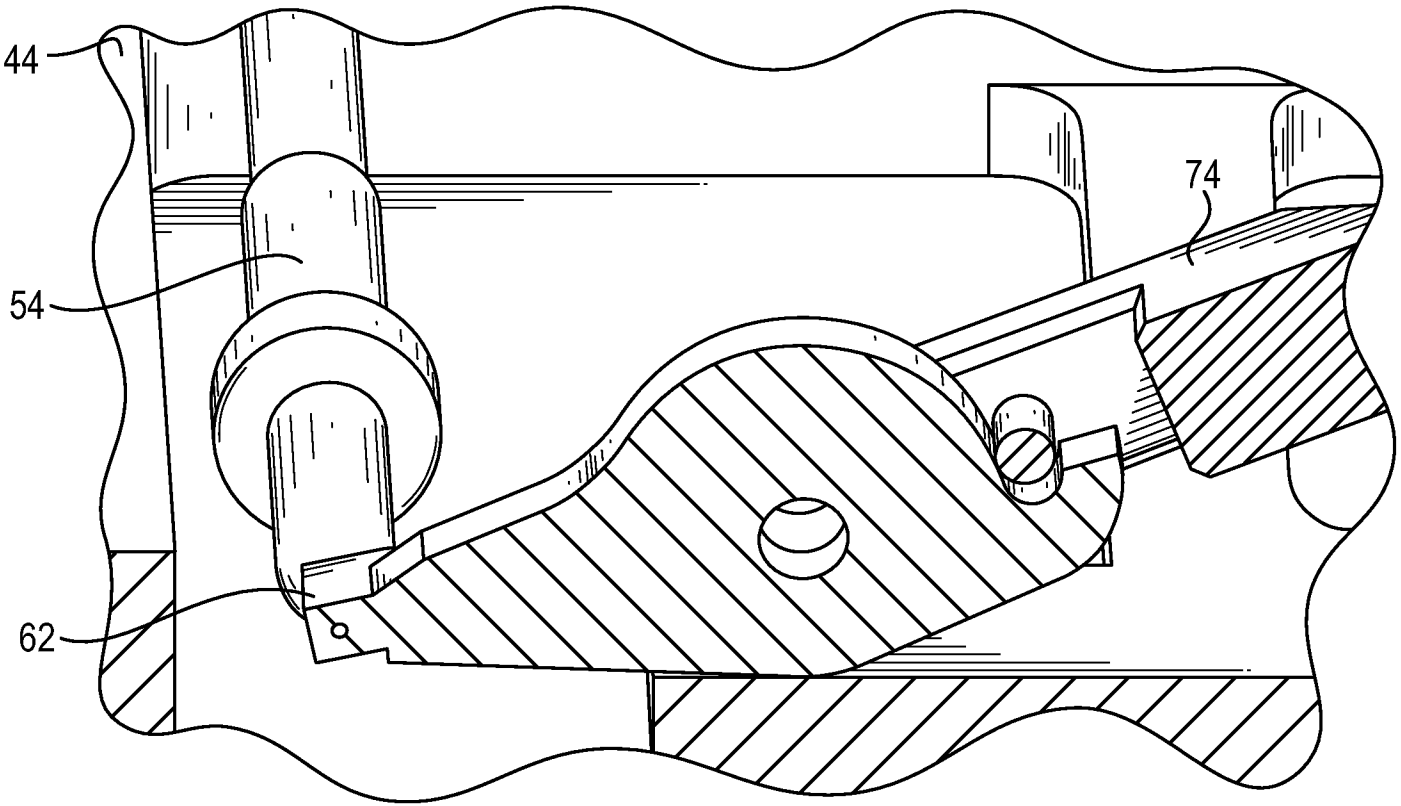
FIG. 10 is an enlarged view of the latch release mechanism of FIG. 9, partially in section, as seen along line 10-10 of FIG. 9.

The locking assembly 52 includes a pair of spring bolts 54, each having a locking bolt or pin 56 and a spring 60 associated with each bolt 56, and a latching means, such as a lock or a latch release mechanism 62. The latch release mechanism 62 is pivotally mounted to the door 44, and has a cam surface 64 (FIGS. 7 and 8) or other surfaces (as shown in FIGS. 9 and 10)

for contacting the bolts 56. The bolts 56 generally lie in a plane parallel to and adjacent the door portion 40 of the end cap 30, and are mounted, such as fitted into, recesses 66 in the frame portion 42. The recesses or bolt holes 66 generally are machined in the material on opposite sides of the frame portion 42 that forms the peripheral skirt 50 at the same time that the material is weakened along the tear lines. The illustrated locking assembly 52 includes a pair of pins or bolts 56 that are substantially axially aligned. The bolts 56 are closely received in the bolt holes 66 for a close fit, and are aligned with the bolt holes 66 with small clearances. The springs 60 bias the bolts 56 out of engagement with the recesses 66 in the frame portion 42 and the latch release mechanism 52 holds the bolts 56 against the springs 60 and into engagement with the recesses 66. In the illustrated embodiment the latch mechanism 62 includes a link or a cam that is interposed between the interior ends of a pair of axially-aligned bolts 56.

Figure 3:
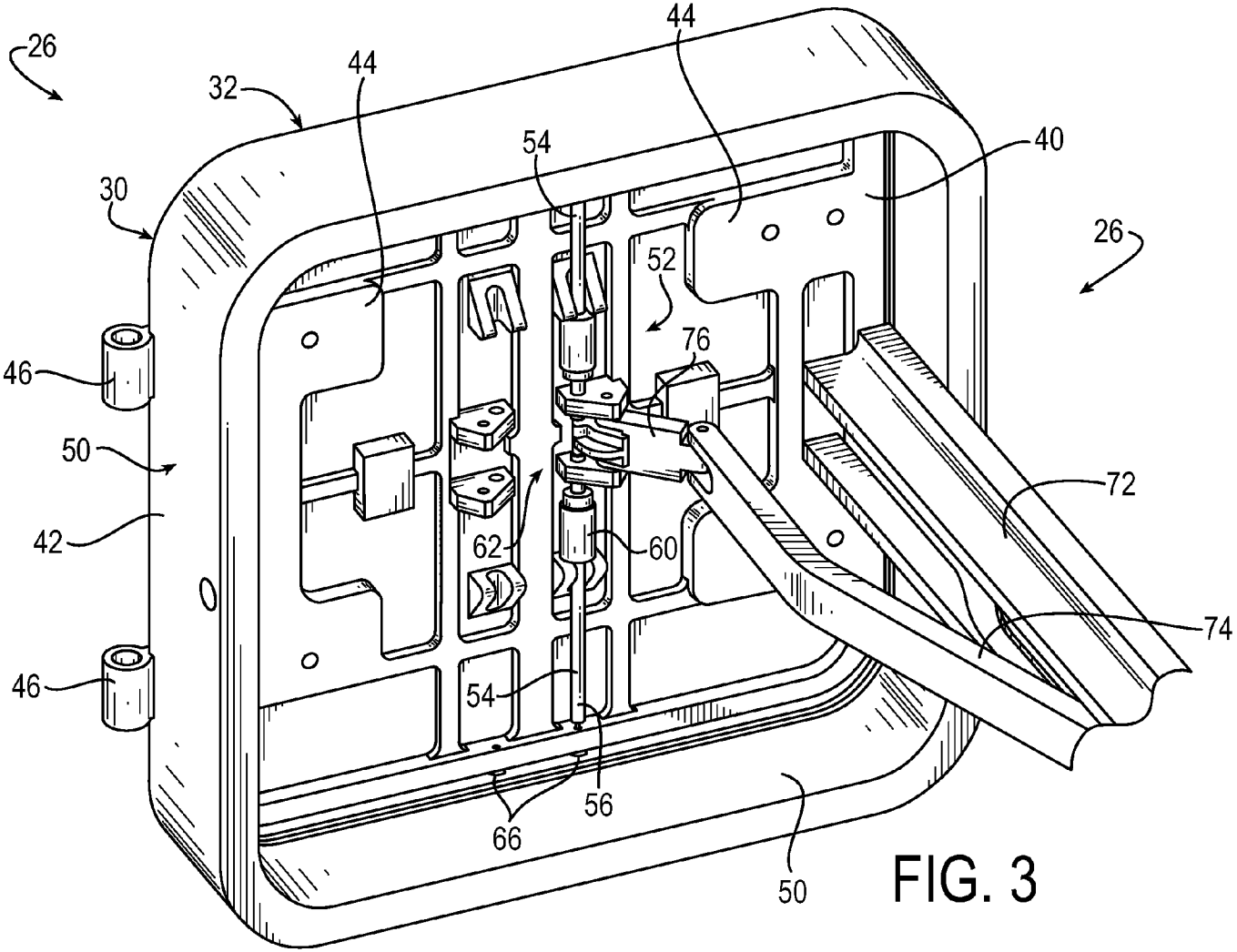
FIG. 3 is an enlarged perspective view of a missile sealing assembly provided by the present invention in a locked and sealed condition.
Figure 4:
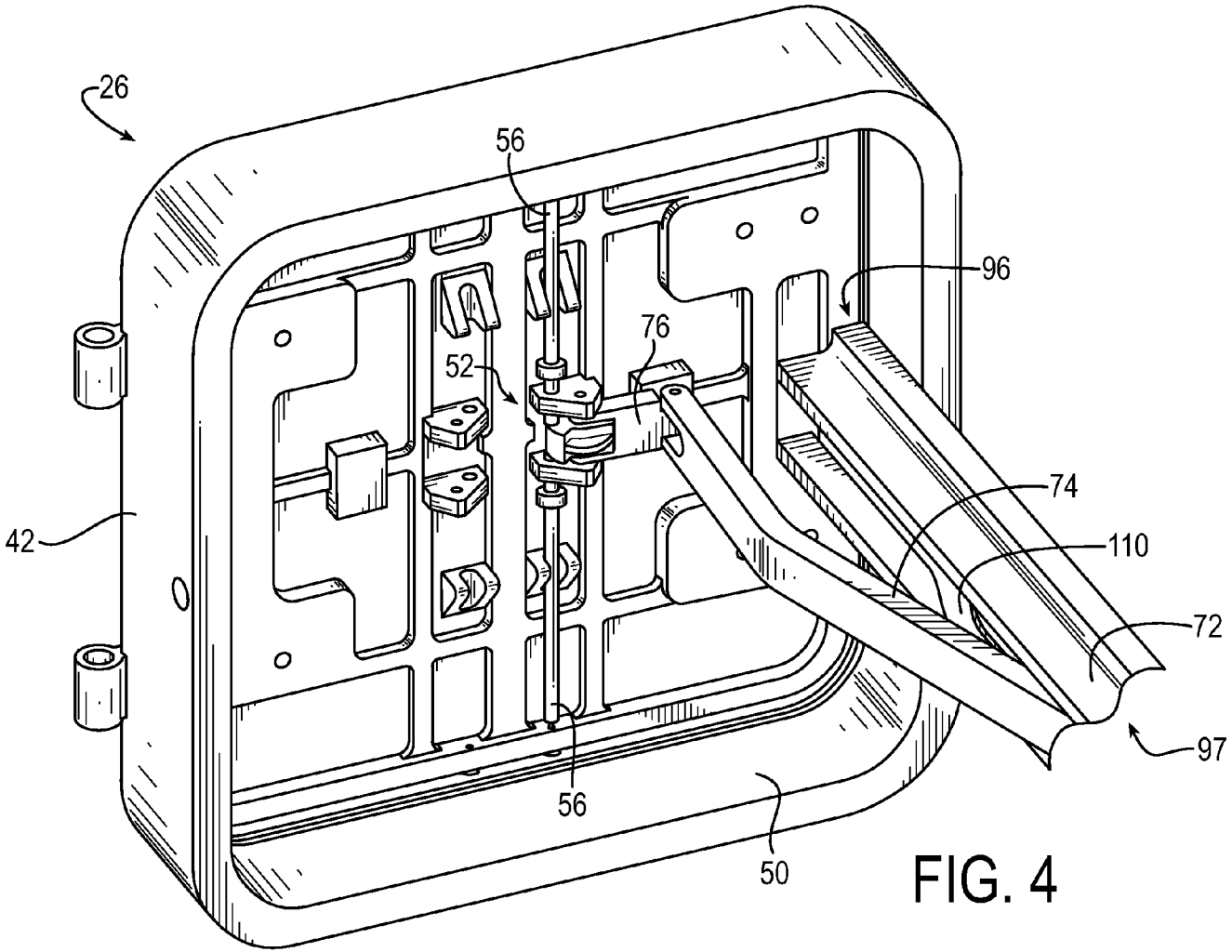
FIG. 4 is an enlarged perspective view of the missile sealing assembly of FIG. 3 in an unlocked and sealed condition.
Figure 5:
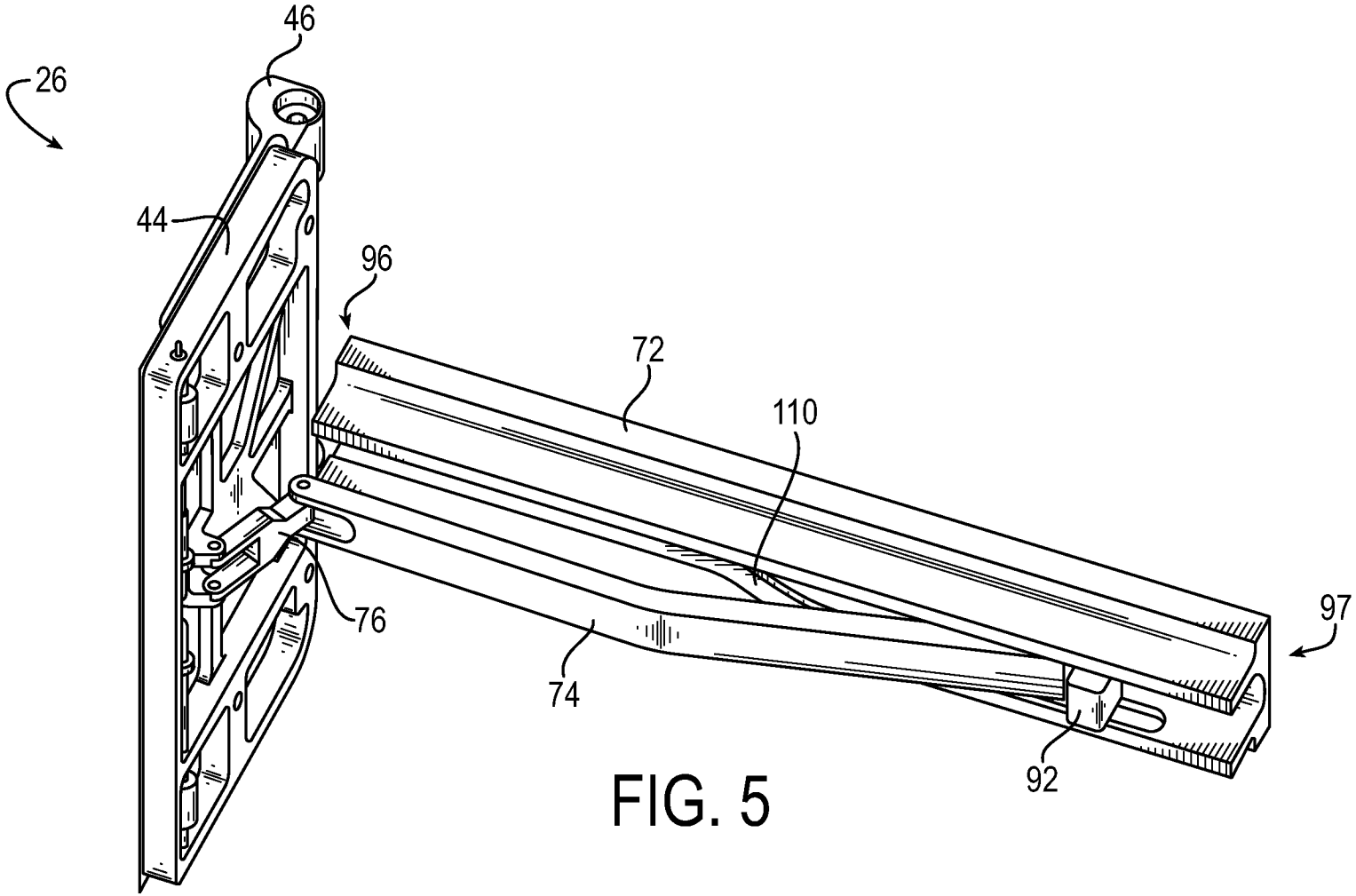
FIG. 5 is another perspective view of the missile sealing assembly provided by the invention showing a door in a closed position.
Figure 7:
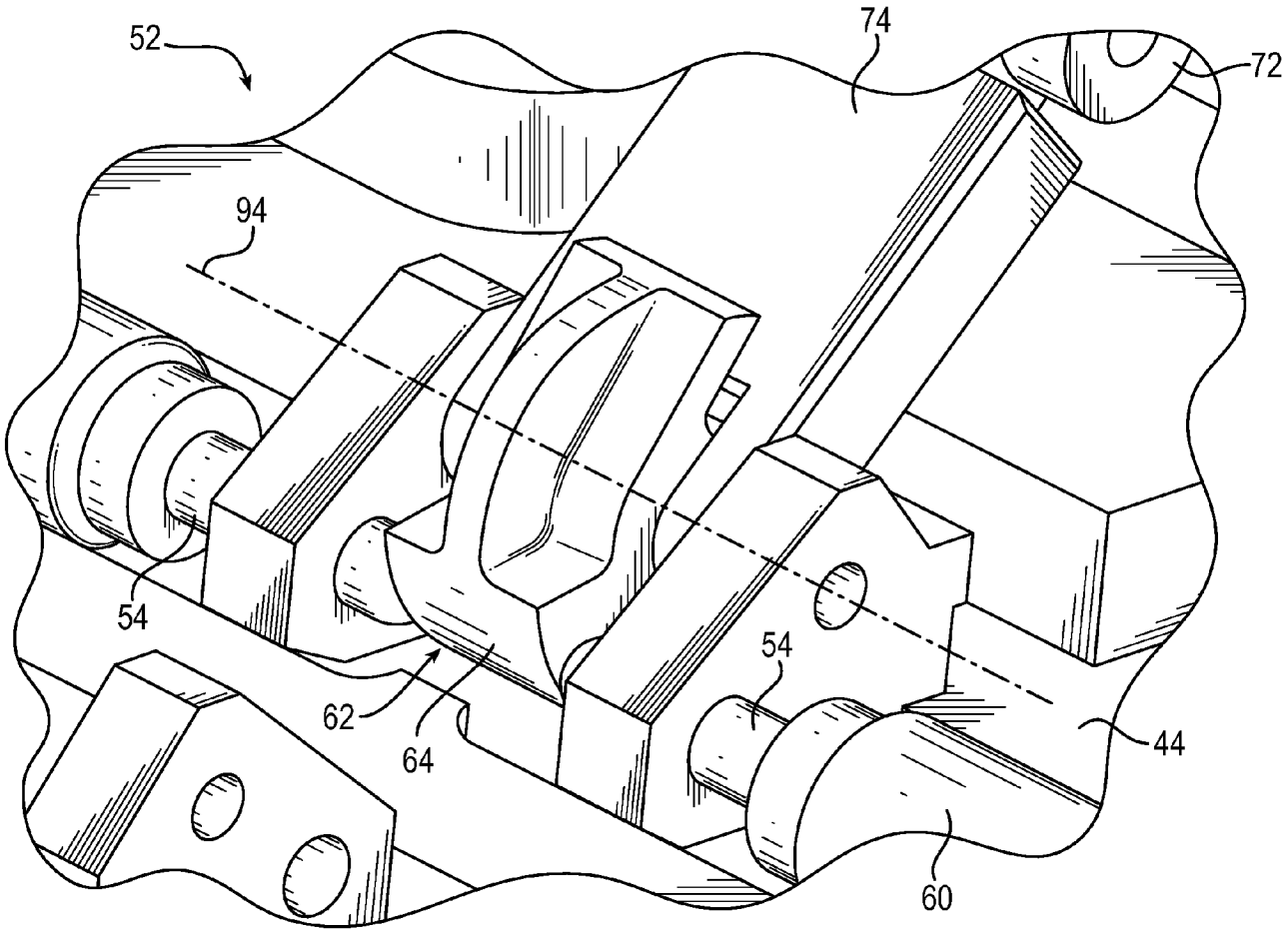
FIG. 7 is an enlarged view of a latch release mechanism provided by the present invention in a locked position.
Figure 8:
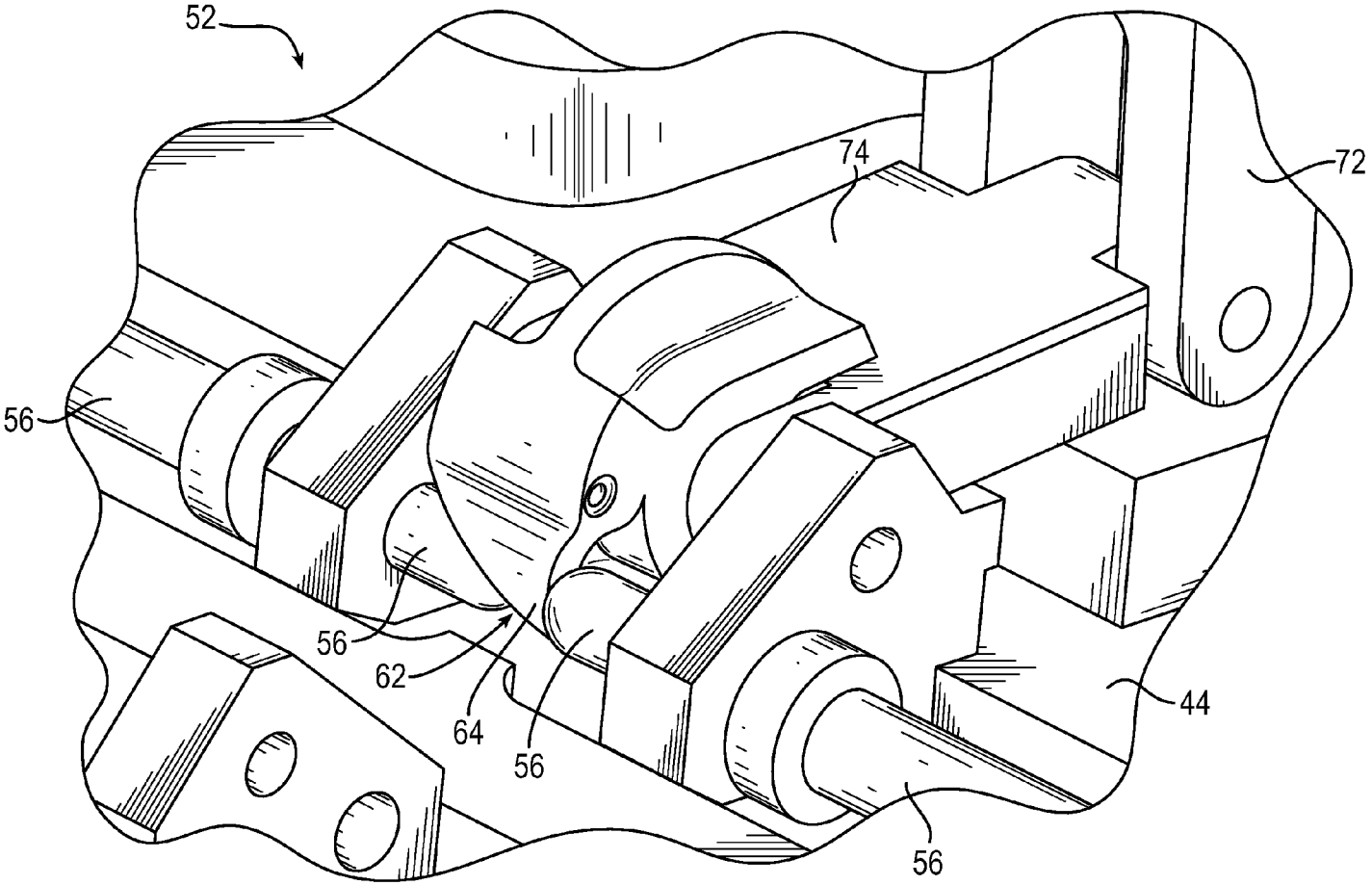
FIG. 8 is an enlarged view of the latch release mechanism of FIG. 7 in an unlocked position.

The bolts 56 are movable between a locking position, where the bolts are received in respective recesses 66 (as shown in FIGS. 3 and 7), and a releasing position, where the bolts 56 are retracted from the recesses 66 (see FIGS. 4 and 8). As such, the latching means, such as the illustrated latch release mechanism 62, retains the bolts 56 in engagement with the frame portion 42 to lock the door 44 in place, and movement of the latch release mechanism 62 allows the bolts 56 to disengage from the frame portion 42, thereby allowing the door 44 to open. Thus, the latch release mechanism 62 holds the bolts 56 in the locking position and the springs 60 bias the bolts 56 against the latch release 62, such that movement of the latch release 62 releases the bolts 56 to move to the biased releasing position.

Thus, the spring bolts 54 and the hinges 46 cooperate to provide structural support for the end cap 30, particularly the door portion 40, in view of the frangible connection between the doors 44 and the frame portion 42 that seal the end cap 30. The added support for the door portion 40 provided by the bolts 56 and the hinges 46 helps to maintain the seal provided by the end cap 30 and protects the missile 22 from overpressure and debris from the exhaust of a missile launched from an adjacent container.

The energy required to open the doors 44 comes from the missile 22 itself, transmitted to the doors 44 through the linkage 34. The linkage 34 is coupled to the missile 22 through a device that is temporarily or permanently attached to the missile 22. In the illustrated system 20, a collar 70 placed around a portion of the missile 22 is used to transfer motion from the missile 22 to a linkage assembly 34, which also may be referred to as just a linkage. Movement of the missile 22 advances the collar 70, which engages to the linkage 34, which in turn opens a respective one of the one or more doors 44 in advance of the missile 22. The collar 70 also may be used to keep the nose of the missile 22 generally centered in the container 24, and typically is circumferentially segmented with at least two segments that can separate and move out of the missile's path as the missile 22 exits the container 24. If the collar 70 also seals against the container walls to contain the rocket gases generated upon launch, the collar 70 can further function as a sabot.

Thus, the linkage 34 is connected to and driven by the missile 22 through the collar 70. A sealing assembly 26 with more than one door 44 has an equivalent number of linkages 34 associated with respective doors 44. Each linkage 34 is associated with a respective door 44 in the door portion 40 of the end cap 30 and controls the position and motion of the door 44. Features of the linkage 34, including lengths of its links, positioning of pivot points, etc., can be varied to control the rate at which the door 44 opens, as well as the profile of the opening of the door 44, and constraint on the door 44 when open to prevent the door 44 from rebounding to a position in the path of the missile 22. The linkage 34 includes a guide track 72, a first link 74, mounted toward one end in the guide track 72 for sliding movement along the guide track 72, and a second link 76 pivotally connected to the first link 74 at a location generally removed from the guide track 72. The second link 76 also is pivotally connected to a door 44 at a location removed from the connection between the first link 74 and the second link 76. The first link 74, which is called the Strut, transmits missile motion ahead of a leading end 90 of the missile 22, i.e., the missile's nose. The Strut 74 is attached to the second link 76, which is called the Link. The Link 76 is in turn pivotally attached to a door 44 and may or may not be spring-biased against the Strut 74. The initial motion of the Strut 74 causes the Link 76 to rotate, thereby moving and releasing the latch release mechanism 62 through which the door 44 is held shut and sealed to the container 24 during storage.

The Link 76 is sprung and detented such that it transmits appropriate forces to the door 44 and the latch release mechanism 62. The Strut 74 is connected to the Link 76 at a location removed from the connection to the door 44, and to the guide track 72 at a location removed from the connection with the Link 76. Particularly, the Strut 74 is mounted for sliding movement relative to and along the guide track 72 for transmitting missile motion ahead of the nose portion 90 of the missile 22, and has a collar-engaging surface 90 at a driven end of the Strut 74 against which a force can be applied from the missile's motion to move the connection between the Link 76 and the Strut 74. As the motion of the Strut 74 causes the Link 76 to rotate, the latch release mechanism 62 rotates, thereby releasing the spring bolts 54 that hold the door 44 shut, and allowing the springs 60 to bias the bolts 56 to the biased releasing position. This release may be achieved by moving the cam surfaces 64 of the latch release mechanism 62 that are in engagement with the ends of the bolts 56, thereby disengaging the bolts 56 from the recesses 66 during rotation of the Link 76. In place of the cam surface 64 of the embodiment of FIGS. 8 and 9, the latch release mechanism 62 can simply move out of the line of action of the spring bolts 56, as shown in the latch release mechanism 62 in FIGS. 9 and 10. The surface 64 of the latch release mechanism 62 may be detented to help hold the ends of the bolts 56 and prevent inadvertent release (in other words, the cam surface 64 provided by the latch release mechanism 62 has indentations or is otherwise recessed to hold the ends of the bolts 56 in engagement with the cam surface 64 during thermal cycling and vibration without allowing the bolts 56 to release from engagement with the frame portion 42).

In addition, while the latch release mechanism 62 and the Link 76 share an axis 94, the latch release 62 is not directly coupled to the Link 76, i.e., the connection between the latch release mechanism 62 and the Link 76 has some backlash or looseness, such that movement while taking up vibration or mechanical tolerances or thermal expansion and contraction inside the container 24 will not compromise the locking assembly 52 and prematurely release the locking bolts 56.

The Link 76 can rotate inwardly or outwardly, towards or away from the center of the door portion 40. In some embodiments, the Link 76 may be rotated to contact the door 44, providing additional force to break the tearable web or frangible connections of the door portion 40. Alternatively, if the breaking load of the web is too great, the Link 76 or the Strut 74 can be fitted with a projection (not shown) to initially pierce and further weaken the tearable web.

Due to the interrelation between the Link 76, the Strut 74, and the collar 70, in some embodiments, and as an added benefit, the Link 76 may during storage react against the Strut 74 to provide retention forces on the collar 70 against the missile nose 90. As such, the Link 76 and the Strut 74 may also provide for collar position tolerance and thermal expansion and contraction motion during storage. In one embodiment, the retention forces on each side of the collar 70 against the missile nose 90 has a minimum value of about 50 lbf (approximately 222 N), on each side of the collar 70, and the Link 76 provides for a collar position tolerance of ±10 mm and a thermal expansion/contraction motion of ±6 mm during storage. The linkage 34 can further include one or more springs or other energy storage devices to preload the linkage against the collar 70 to help keep the collar 70 in place.

At its collar end, the Strut 74 is guided by the guide track 72. The guide track 72 defines a longitudinally-extending path for slideable mounting of the first link, the Strut 74, the path extending between first and second open ends 96 and 97 of the guide track 72. The guide track 72 typically extends along an internal longitudinal length of the missile container 24, and is mounted to an inner surface of the missile container 24. Alternatively the guide track 72 may be mounted only to the frame portion 42 of the end cap 30. The first open end 76 of the guide track 72 may be disposed adjacent the open forward end 32 of the missile container 24, adjacent the end cap 30. This open end 76 of the guide track 72 facilitates assembly, making it easier to slide the Strut 74 into the guide track 72. Further, in some embodiments, the guide track 72 may define a nonlinear path, although it will be appreciated that the path may also be linear. In the illustrated embodiment, the guide track 72 defines a nonlinear path 110 that moves outwardly as the path 110 approaches the first open end 96 of the guide track 72 adjacent the end cap 30, thereby guiding the collar end of the Strut 74 outward as the Strut 74 moves along the path 110 defined by the guide track 110 and out of the path of the collar 70.

At launch initiation, the missile 22 moves forward in the container 24, toward the sealed end cap 30. As it does so, the collar 70 on the missile 22 engages the linkage 34, specifically the Strut 74, and moves the Strut 74 along the path 110 defined by the guide track 72. As forward motion of the missile 22 continues, the Strut 74 causes the door 44 to begin opening ahead of and without contact with the leading end 90 of the missile 22. At the same time, on firing a small free but sprung motion (about 10 mm, for example) of the collar 70 from the forward-most stored position is provided by the Link 76. As the missile 22 continues its forward motion, movement of the Link 76 (through about 14 mmm, for example) unlocks the doors 44, rotating the latch release mechanism 62 and releasing the sprung bolts 54. A further small motion (about 5 mm) of the Link 76 at increasing load can be available to cushion impact loads at the commencement of the doors' opening.

Figure 6:
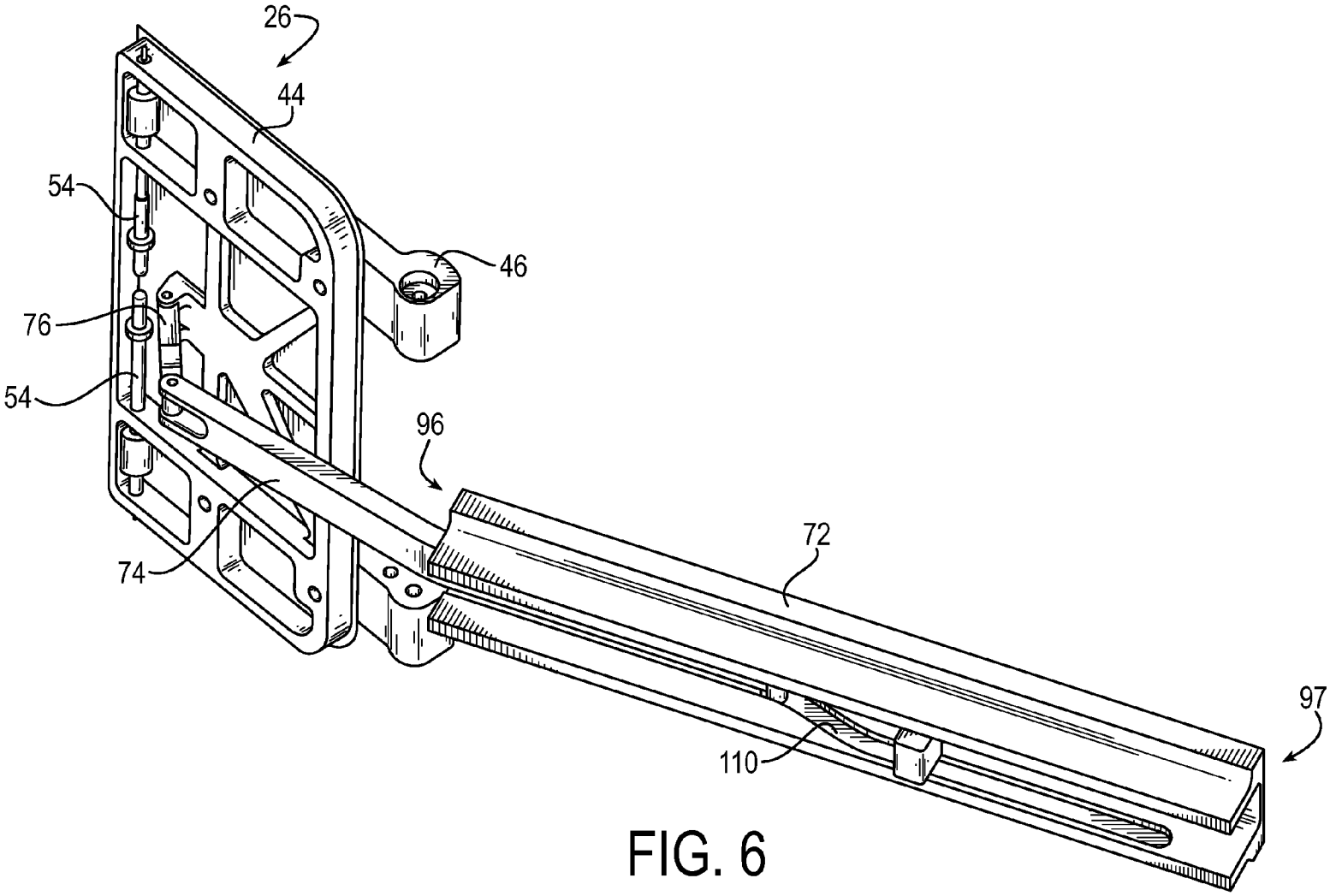
FIG. 6 is a perspective view of the missile sealing assembly of FIG. 5 showing the door in an open position.

Continuing forward motion of the collar 70 (and missile 22) drives the Strut 74 forward, via the Link 76, until the door 44 reaches its opened locking position (FIG. 6), at which point reverse door motion is prevented by the alignment of the Strut 74 and the Link 76, but not over-center motion towards a cushioned stop. The missile 22 generally is accelerating rapidly at this point. Yet by the time the doors 44 of the container 24 approach their fully open positions, the Strut 74 disengages from the collar 70 and the missile 22 and moves out of the missile's way.

Thus the door's opening is positively controlled by the collar motion until the door 44 reaches the open and locked position. On reaching this position the collar's motion can then proceed unhindered towards separation from the missile nose 90.

It is possible that further forward motion of the collar 70 will create a rapidly rising load on the Strut 74 as the free motion of the Link 76 is exhausted (as the door 44 reaches its open and locked position). This causes the Link 76 to break free of a restraining detent (created by a spring or shear pin, not shown) such that over-center motion of the Strut 74 is permitted. As the Strut 74 approaches its limit of forward motion, the collar end of the Strut 74 is diverted laterally outwardly by the guide track 72, thereby disengaging the collar 70 from the Strut 74 and the missile 22 and throwing the collar 70 forward and outward.

As demonstrated, the present invention provides a missile sealing assembly 26 for actuation of fixed mechanical container doors 44, achieved solely by missile launch motion without additional system interfaces. Advantageously, the present invention provides a sealing assembly 26 that minimizes contact with sensitive missile parts, and produces little to no debris in the process, as compared to other conventional solutions, such as burst-through diaphragm end caps. Note also that as compared to a missile container utilizing a separate system, such as a system of actuators and batteries, to open the container, the missile container sealing assembly 26 of the present invention provides the added benefit of reducing the weight of the missile container 24. Additional advantages of the present invention also include high integrity environmental sealing, use in multiple launch systems where adjacent rocket blast may be present, use with underwater launch containers, and reduction or elimination of damage risk to the missile as it exits the container as compared to conventional systems that generate substantially more debris. Even further, minimal or no delay is imposed on the missile's reaction time for container opening, as compared to missile systems having separate assemblies for container opening. For example, in testing at real speeds on a full scale test assembly, the door opening times are in the order of 50 milliseconds, and computer modeling suggests operating Strut loads are on the order of about 3500N (800 lbf) at 50° door angle at about 32 milliseconds after launch initiation.

In summary, the present invention provides a missile container sealing assembly 26 that includes an end cap 30 capable of sealing an end of a container 24 for a missile 22, and one or more linkage assemblies 34 for controllably opening doors 44 in the end cap 30. The end cap 30 has a frame portion 42 that defines an opening for a missile 22 and is mountable to the end of the missile container 24, and a door portion 40 that includes one or more doors 44 that close and seal the opening in the frame portion 42. Each linkage assembly 34 is associated with a respective one of the one or more doors 44, for opening the doors 44 relative to the frame portion 42. Moreover, each linkage assembly 34 includes a link 74 that transmits a force ahead of the leading end 90 of the missile 22 to open the doors 44 and permit the missile's egress through the opening.

The present invention also provides a method a method of opening a missile container 24 to permit egress of a missile 22 from the missile container 24, in a missile system 20 that includes the missile container 24 and the missile 22 contained therein. The method includes the steps of (a) initiating missile launch to move a missile collar 70 against a linkage 34 coupled to a door 44 in an end cap 30 sealing an end 32 of the missile container 24, the linkage 34 including a first link 74 coupled between a second link 76 and the collar 70 coupled to the missile 22, and a second link 76 coupled between the first link 74 and the door 44; (b) sliding the first link 74 along a guide track 72 contained at least partially within the missile container 24; (c) rotating the second link 76 relative to the door 44 via contact with the first link 74; and (d) opening the door 44 of the missile container 24 via transfer of force from the second link 76 to the door 44, causing the door 44 to rotate away from a path of the missile 22.

Although the invention has been shown and described with respect to a certain preferred embodiment, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention can have been disclosed with respect to only one of the several embodiments, such feature can be combined with one or more other features of the other embodiments as may be desired and advantageous for any given or particular application.

What is claimed is:

1. A missile container sealing assembly, comprising:

an end cap capable of sealing an end of a container for a missile, the end cap having a frame portion that defines an opening for a missile at an end of a container and is mountable to an end of a missile container, and a door portion that includes one or more doors that close and seal the opening in the frame portion, each door being hingedly mounted to the frame portion; and one or more linkage assemblies, each linkage assembly being associated with a respective one of the one or more doors, for opening the doors relative to the frame portion to permit a missile to exit through the opening in the frame portion, where each linkage assembly includes a first link, a second link pivotally connected to the first link and to the door at a location removed from the connection to the first link, and a guide track, where the first link is pivotally connected to the guide track at a location removed from the connection between the first link and the second link, and the first link being mounted for sliding movement relative to and along the guide track, the first link further including a surface against which a force can be applied to move the connection between the first link and the guide track along the guide track and to transfer a force to the second link and the door to cause the door to open.

2. An assembly as set forth in claim 1, where both the frame portion and the door portion are formed as a unitary structure, and the one or more doors are defined by frangible tear lines in the unitary structure that separate the one or more doors from the frame portion, and from each other if there is more than one door.

3. An assembly as set forth in claim 1, where the end cap includes one or more hinges mounted to both the frame portion and each of the one or more doors, such that the doors can be rotated relative to the frame portion.

4. An assembly as set forth in claim 3, where the hinges are mounted on an outside surface of the frame portion and the one or more doors.

5. An assembly as set forth in claim 1, where the door portion is substantially planar.

6. An assembly as set forth in claim 1, where the frame portion has a skirt that extends in a direction perpendicular to the door portion.

7. An assembly as set forth in claim 1, comprising at least two recesses in the frame portion and a locking assembly adjacent at least one door that cooperates with the recesses in the frame portion to lock the door in place, the locking assembly including a pair of locking bolts and a spring associated with each bolt that biases the bolt out of engagement with the frame portion, and a latch release connected to the second link, where the bolts are mounted to the door, aligned with the recesses in the frame portion, and are movable between a locking position where the bolts are received in respective recesses, and a releasing position where the bolts are retracted from the recesses, the latch release holding the bolts in the locking position and the springs bias the bolts against the latch release, such that movement of the latch release permits the bolts to move to the biased releasing position.

8. An assembly as set forth in claim 7, where the bolts lie in a plane parallel to and adjacent the door portion.

9. An assembly as set forth in claim 7, where the latch release is pivotally mounted to the door.

10. An assembly as set forth in claim 1, where the guide track defines a longitudinally-extending path.

11. An assembly as set forth in claim 1, where the guide track is open adjacent the frame.

12. An assembly as set forth in claim 1, where the guide track defines a nonlinear path.

13. An assembly as in claim 1, further comprising a locking assembly including one or more bolts mounted between the door portion and the frame portion to lock the door in place; and a release means mounted between the bolts and the second link for retaining the bolts in engagement with the frame portion;

wherein movement of the release means allows the bolts to disengage the frame portion, thereby allowing the door to open.

14. An assembly as in claim 13, where the release means is a latch release having a cam surface.

15. An assembly as set forth in claim 2, where the end cap further comprises:

recesses in the frame portion of the unitary structure; and bolts parallel to the door portion that are received in the recesses for providing structural support to the doors adjacent the frangible tear lines, the bolts being separate from the one or more linkage assemblies.

16. An assembly as set forth in claim 1, further comprising a collar for surrounding at least a nose portion of a missile, the collar mounted for sliding movement relative to and along the guide path;

wherein movement of the collar along the guide path causes contact with and movement of the second link.

17. An assembly as set forth in claim 16, where the collar extends along a lateral length, where the guide track defines a nonlinear path, and where the nonlinear path includes a portion outwardly removed from a path of the collar along the guide track.

18. In combination, the assembly of claim 1, a container having an open end, and a missile contained in the container, where the end cap is mounted to the container to close and seal the open end of the container, and the first link is connected to the missile such that ignition of the missile pushes the missile against the first link, urging the first link along the guide track.

19. A combination as set forth in claim 18, where the frame portion of the end cap is attached to the container, and the first link is connected to the missile through a collar.

20. A method of opening a missile container of a missile system during egress of a missile from the missile container, the missile system including the missile container and the missile contained therein, the method comprising the steps of:

(a) initiating missile launch to move a missile collar against a linkage coupled to a door in an end cap sealing an end of the missile container, the linkage including a first link coupled between a second link and the collar, the collar coupled to the missile, and the second link coupled between the first link and the door;

(b) sliding the first link along a guide track contained at least partially within the missile container;

(c) rotating the second link relative to the door via contact with the first link; and (d) opening the door of the missile container via transfer of force from the second link to the door, causing the door to rotate away from a path of the missile.

* * * * *